United States Patent [19]

Bellow

[11] Patent Number: 4,842,314

[45] Date of Patent: Jun. 27, 1989

[54] PIPE LIFT CAP ASSEMBLY

[76] Inventor: Don W. Bellow, P.O. Box 608, Carencro, La. 70520-0608

[21] Appl. No.: 172,475

[22] Filed: Mar. 24, 1988

[51] Int. Cl.[4] ..... B66C 1/16; B66C 1/62

[52] U.S. Cl. ..... 294/74; 294/82.13

[58] Field of Search ..... 294/1.1, 4, 67.1, 67.3, 294/67.33, 67.5, 74, 81.1, 81.5, 81.56, 82.1, 82.11–82.13, 90, 92

[56] References Cited

U.S. PATENT DOCUMENTS

| | | | |
|---|---|---|---|
| 609,417 | 8/1898 | Day | 294/74 |
| 909,250 | 1/1909 | Starbird | 294/82.13 |
| 1,639,786 | 8/1927 | Steinmetz | 294/74 X |
| 2,676,835 | 4/1954 | McKinney | 294/74 |
| 3,350,129 | 10/1967 | Novak | 294/74 X |
| 3,606,441 | 9/1971 | Ridgely | 294/74 X |
| 4,092,038 | 5/1978 | Harris | 294/82.11 |
| 4,139,179 | 2/1979 | Kukulski | 294/74 X |
| 4,397,493 | 8/1983 | Khachaturian et al. | 294/81.1 |

FOREIGN PATENT DOCUMENTS

| | | | |
|---|---|---|---|
| 205672 | 1/1984 | German Democratic Rep. | 294/81.5 |
| 235272 | 1/1969 | U.S.S.R. | 294/67.3 |
| 466164 | 6/1975 | U.S.S.R. | 294/74 |
| 867839 | 9/1981 | U.S.S.R. | 294/81.5 |
| 1432248 | 4/1976 | United Kingdom | 294/67.1 |

*Primary Examiner*—Johnny D. Cherry

*Attorney, Agent, or Firm*—Pravel, Gambrell, Hewitt, Kimball & Krieger

[57] ABSTRACT

First and second cap members, each cap substantially cylindrical in shape and of an interior diameter slightly larger than the outer diameter of the ends of a section of drill casing. The cap members are open ended at a first end and are sealed via a bottom on a second end, for defining an annular space there within for slipping on to the end portions of a section of casing. There is further provided a lifting lug along the length of the wall of the cap member, the lifting lug including a bore through its body for attaching a length of steel cable therethrough, each lifting lug and steel cable attached thereto forming the lifting assembly of the second ends of the cable attached to a common line for lifting. Each cap member would further include a handle portion extending from the end plate of the cap along its side wall attached to the lifting lug for defining a means for manually lifting the cap and positioning each cap upon the end portion of the section of casing.

8 Claims, 1 Drawing Sheet

PIPE LIFT CAP ASSEMBLY

BACKGROUND OF THE INVENTION

1. Field of the Invention

The apparatus of the present invention relates to lifting of drill casing. More particularly, the present invention relates to an apparatus positionable along the first and second ends of a length of drill casing for lifting the section of drill casing substantially parallel to the ground.

2. General Background

In the drilling of oil wells, one of the more necessary components in the drilling process is the need for numerous sections of drill casing which are assembled end to end for forming a casing around the drill string, on the end of which is rotated a drill bit for the drilling of the hole. Each length of drill casing measures approximately a standard length of twenty to forty feet, and weighs up to three to four thousand pounds. It is readily foreseeable in the drilling of a standard oil well, which may go to a depth of thirty to forty thousand feet, that literally thousands of sections of drill casing must be placed end to end. One of the practical problems involved in supplying this drill casing is the transport of the drill casing from one point to another point, for example, from the pipe yard to a transport truck, and from the transport truck perhaps to the drill site, and subsequently on to the drill platform. Often times, this transport is accomplished with the use of a harness or sling which is simply swung around the length of a pipe, and a crane or the like lifts the section of pipe precariously balanced in the sling and positions at its end destination point. It is quite obvious that such an operation is often times dangerous and hazardous to the workers in the area, and requires a great deal of positioning of the sling in order to properly balance the section of pipe so that the pipe does not fall from the sling and cause damage or injury to personnel.

Several patents have been issued which are pertinent to the art, those patents listed in the following columns as follows:

| PATENT NO. | INVENTOR | TITLE |
|---|---|---|
| 4,126,347 | Hogue | PUMP HOUSING SLING |
| 626,350 | Tiffany | STEVEDORE"S LIFTING HOOKS |
| 991,980 | Harper | RAIL HANDLING DEVICE |
| 1,021,564 | Warnitz | HOISTING APPARATUS |
| 2,654,629 | Renfroe | HORIZONTAL PLATE LIFTING CLAMP |
| 4,359,241 | Kistner | DRUM HOLDER |
| 3,488,079 | Stinchfeld | BARREL LIFTERS |
| 4,139,179 | Kuklaki | HOISTING APPARATUS |

SUMMARY OF THE PRESENT INVENTION

The apparatus of the present invention solves the shortcomings of the art in a simple and straightforward manner. What is provided are first and second cap members, each cap substantially cylindrical in shape and of an interior diameter slightly larger than the outer diameter of the ends of a second of drill casing. The cap members are open ended at a first end and are sealed via an end plate on a second end, for defining an annular space there within for slipping on to the end portions of a section of pipe. There is further provided a lifting lug along the length of the wall of the cap member the lifting lug including a bore through its body for attaching a length of steel cable therethrough, each lifting lug and steel cable attached thereto forming the lifting assembly of the second ends of the cable attached to a common line for lifting. Each cap member would further include a handle portion extending from the end plate of the cap along its side wall attached to the lifting lug for defining a means for manually lifting the cap and positioning each cap upon the end portion of the section of casing.

Therefore, it is a primary object of the present invention to provide an assembly for lifting sections of pipe to assure that the section of casing is lifted in a position substantially parallel to the ground;

It is a further object of the present invention to provide a lifting assembly for a section of casing so that the casing is lifted at each end portion yet maintained balanced through the use of a common centrally located line;

It is still a further object of the present invention to provide a lifting assembly for a section of casing including a pair of cap members each of the cap members positionable upon each end of the section of casing, and including a length of cable meeting at a common centrally located point for lifting the section of casing parallel to the ground.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
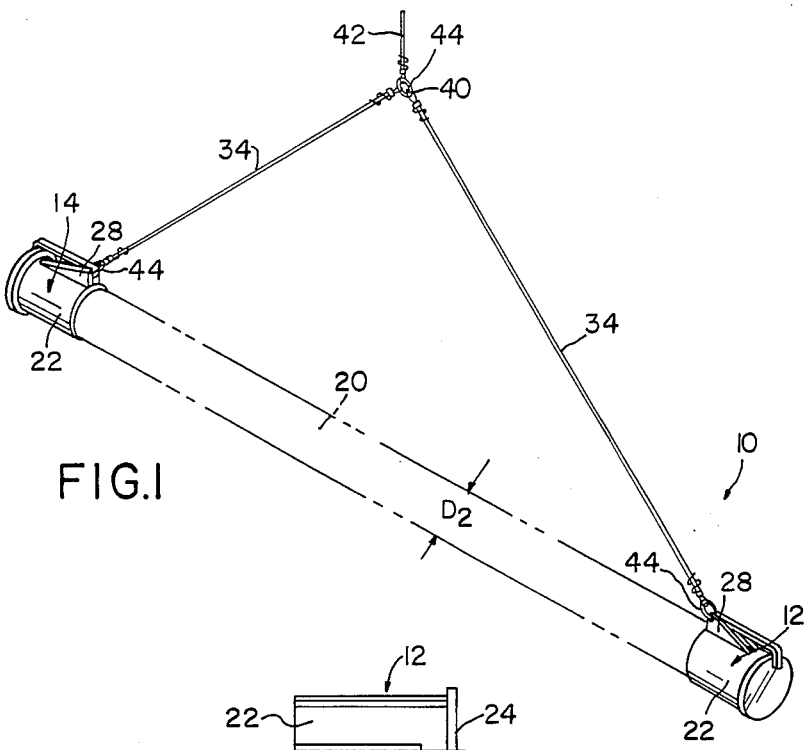
FIG. 1 illustrates an overall perspective view of the lifting assembly of the preferred embodiment of the present invention.
Figure 5:
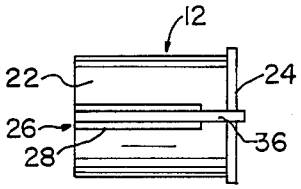
FIG. 5 illustrates a top view of a lifting cap of the preferred embodiment of the apparatus of the present invention.
Figure 3:
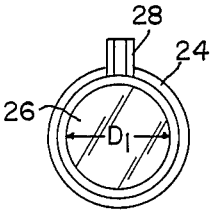
FIG. 3 illustrates the front view of the lifting cap of the preferred embodiment of the present invention.
Figure 2:
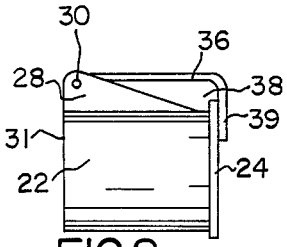
FIG. 2 illustrates a side elevational view of the lifting cap of the present invention.
Figure 4:
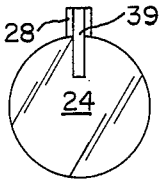
FIG. 4 illustrates a rear view of the preferred embodiment of the assembly of the present invention.

FIGS. 1–6 illustrate the preferred embodiment of the assembly of the present invention which is illustrated in particular in FIG. 1 by the numeral 10. As seen in the Figures, lifting assembly 10 comprises a first cylindrical cap member 12, a second cylindrical cap member 14, each of the cylindrical cap members 12 and 14 slidably positionable upon the end portion of a length of drill casing 20 (as represented in phantom view) in FIG. 1. As illustrated in the Figures, cap members 12 and 14 would include annular wall portion 22 with an end plate 24 positioned via welding or the like to the front end of the wall portion 22, annular wall portion 22 defining interior space 26 serving as a means for placing the end portion of a drill casing there into. For purposes of construction, the interior diameter D1 of space 26 would be slightly larger than the outer diameter D2 of the section of drill casing 20 so that the end portion of the drill casing 20 may slide easily into the space 26 as defined by annular wall 22. Further, as seen in the Figures, each cap member 12, 14 includes a triangular shaped lifting lug 28 which comprises a triangulated shaped portion of metal secured via welding or the like to the caps 12, 14 along their length, and including a bore 30 for that portion of the lug adjacent the open end 31 of caps 12, 14 for attaching a steel cable 34 to each of the lifting lugs 28 respectively, as seen FIG. 1.

Further, in order to facilitate the positioning of caps 12 and 14 upon the ends of the section of pipe 20, there is included a means of manually positioning the lifting caps onto the end portions of pipe 20. This means would include a handle member 36 as seen more clearly in FIG. 2, member 36 in the preferred embodiment attached to the upper most portion of the lifting lug 28 and extending along the length of the side wall 22 of cap members 12 and 14, yet set a distance apart for defining a grasping space 38 between the handle 36 and the wall 22 of the caps, the outer most portion of the handle 36 forming a right angle, the end 39 to be secured onto the end plate 24 of cap members 12 and 14 via welding or the like. Therefore, a person may grasp handle 36 of cap members 12 and 14 and slidably engage each cap member 12 and 14 to the end portion of length of pipe 20, so that the pipe is ready to be lifted by the assembly of the present invention.

Figure 6:
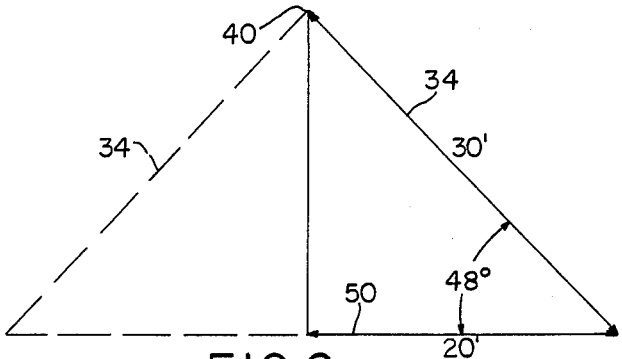
FIG. 6 illustrates a representational view of the angular configuration of the lifting assembly relative to the position of the pipe in the preferred embodiment of the apparatus of the present invention.

FIG. 1 illustrates lifting of a section of pipe 20 by each lifting cap 12, 14 slidably engaged upon the end portions of the length of pipe 20. It is noted that to each lifting cap 12, 14 there is attached a length of steel cable 34, respectively, with the end of each steel cable 34 threaded through the bores 30 of each lifting lug 28, and with the second end of the steel cables joined at an apex 40 and onto a common line 42, with the apex 40 of steel cables 34 being midway along the length of drill casing 20 as schematically represented in FIG. 6.

For purposes of construction, the connections between cables 34 to lugs 28 and cables 34 to cable 42 would be preferably through a rig connector 44 as illustrated. As seen in the Figures, each length of steel cable 34 being of a specified equal length, in the preferred embodiment, the angular relation between the cables and the length of drill casing 20, as represented by arrow 50 in FIG. 6, would be 48° from the horizontal. Therefore, for example, if the length of drill casing were to be 40 feet long, as represented in FIG. 6, in order to achieve the 48° angle between the section of drill casing 20 and the length of cables 34, each cable would have to be approximately 30 feet in length to be jointed at the apex 40 as seen in FIG. 6. As illustrated in FIG. 1, apex 40 is the tie in between cables 34 and common line 42. Therefore, the section of drill casing 20 may be lifted in a manner which maintains it substantially parallel the ground, and upon being placed in position, each of the lifting caps 12, 14 are manually and easily slid off of each of the end portions of drill casing 20, and may be affixed quite easily to the end portions of a subsequent section of drill casing 20 for likewise lifting it in the manner as was described.

Because many varying and different embodiments may be made within the scope of the invention concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An assembly for lifting individual sections of drill casing, the assembly comprising:

(a) a first cap member positionable to encircle the end portion of a section of drill casing to be lifted;

(b) a second cap member positionable to encircle the second end portion of the section of drill casing to be lifted;

(c) lifting lug means secured to an outer wall of each of the first and second cap members for attaching a lifting cable thereonto; and (d) means attachable to a second end of the lifting cables at a common apex for lifting the section of drill casing upwardly in a substantially horizontal fashion.

2. The assembly in claim 1 further including a handle member on each of the first and second cap members for manually sliding the cap members onto and off of each end portion of the section of casing.

3. The assembly in claim 1, wherein each of the lifting lugs secured to the outer wall of the cap members further comprises a bore therethrough for accepting a length of cable.

4. The assembly of claim 1, wherein the means for lifting the drill casing in substantial horizontal fashion further comprises a length of lifting cable of equal length threadable through a bore of each of the lifting lugs and joined at a common apex above substantially the central line of length of drill casing assuring that the drill casing is maintained at the position horizontal throughout the lifting path.

5. An assembly for lifting a section of drill casing so that the drill casing is maintained in a horizontal position along the lifting path, the assembly comprising:

(a) first and second cap members, each cap member including an annular wall, substantially circular in cross-section and of a diameter slightly larger than the diameter of a section of drill casing, each cap member slidably positionable along a first and second end portion of each section of drill casing to be lifted;

(b) a lifting lug fixedly secured to the upper portion of an outer surface of the annular wall of each of the cap members, the lifting lug having a bore therethrough;

(c) first and second lengths of cable secured to the lifting lugs of the first and second cap members, each of said lengths of cable being of substantially equal length; and (d) means for joining a second end portion of each of the lengths of cable at a common apex, each end portion of the drill casing lifted from its rest position in a horizontal fashion during the travel path of the casing.

6. An assembly for lifting individual sections of drill casing, the assembly comprising:

(a) a first cap member positionable to encircle the end portion of a section of drill casing to be lifted;

(b) a second cap member positionable to encircle the second end portion of the section of drill casing to be lifted;

(c) means secured to an outer wall of each of the first and second cap members for attaching a lifting cable there onto;

(d) means attachable to a second end of the lifting cables for lifting the section of drill casing upwardly in a substantially horizontal fashion; and (e) a handle member on each of the first and second cap members defining means for manually grasping each of the cap members for sliding each of the cap members onto and off of each end portion of the section of drill casing to be lifted.

7. The apparatus in claim 6, wherein each cap member further includes a first sealed end and a second open end for slipping the pipe thereinto.

8. The apparatus in claim 6, wherein the means secured to the outer wall of each of the first and second cap members for attaching a lifting cable further comprises a lifting lug welded to the outer wall of the cap members.

* * * * *